United States Patent [19]

Weber et al.

[11] Patent Number: 4,878,351

[45] Date of Patent: Nov. 7, 1989

[54] CRYOSTAT

[75] Inventors: Markus Weber; Andreas Ryser, both of Dubendorf; Rene Jeker, Hombrechtikon, all of Switzerland

[73] Assignee: Spectrospin AG, Switzerland

[21] Appl. No.: 222,042

[22] Filed: Jul. 20, 1988

[30] Foreign Application Priority Data

Jul. 24, 1987 [DE] Fed. Rep. of Germany ..... 3724569

[51] Int. Cl.[4] ..... F25B 19/00

[52] U.S. Cl. ..... 62/51.1; 62/297

[58] Field of Search ..... 62/45, 514 R, 297

[56] References Cited

U.S. PATENT DOCUMENTS

| | | | |
|---|---|---|---|
| 3,251,501 | 5/1966 | Mesnager | 220/445 |
| 3,380,611 | 4/1968 | Brougham et al. | 220/445 |
| 3,913,775 | 10/1975 | Ozaki | 220/445 |
| 4,291,541 | 9/1981 | Kneip, Jr. et al. | 62/45 |
| 4,300,354 | 11/1981 | Buchs et al. | 220/445 |
| 4,481,778 | 11/1984 | Reinker et al. | 62/45 |

OTHER PUBLICATIONS

Cryogenic Eng., Vol. 24, pp. 283 to 289, R. C. Niemann, J. D. Gonczy, and K. F. Mataya: "An Epoxy Fiberglass Tension Member Support for Superconducting Magnets".

*Primary Examiner*—Ronald C. Capossela
*Attorney, Agent, or Firm*—Walter A. Hackler

[57] ABSTRACT

The components of cryostats are interconnected by means of tension members which are frequently made from a fiber glass reinforced plastic material. Such members, which exhibit a rectangular cross-section and bores for receiving the mounting bolts have shown to be not fully reliable because they tend to break easily in the areas of the bores. Consequently, loop-like tension members have been frequently used; but their production is expensive and connected with considerable production tolerances. The invention proposes to use a tension member which is cut out from a plastic sheet material reinforced by a fiber glass weave, and which comprises an elongated portion (21) with parallel edges, followed on both ends by enlarged areas (22) with bores (25) for the mounting bolts. The transition between the central area (21) and the enlarged areas (22) is formed by a transition portion (23) with arc-shaped edges (24). The tension members can be fastened directly on the walls of the components to be interconnected, by means of screws. The resilience of the sheet material enables spaces directed vertically to the plane of the sheet material of the tension member to be bridged.

15 Claims, 2 Drawing Sheets

CRYOSTAT

Figure 1:
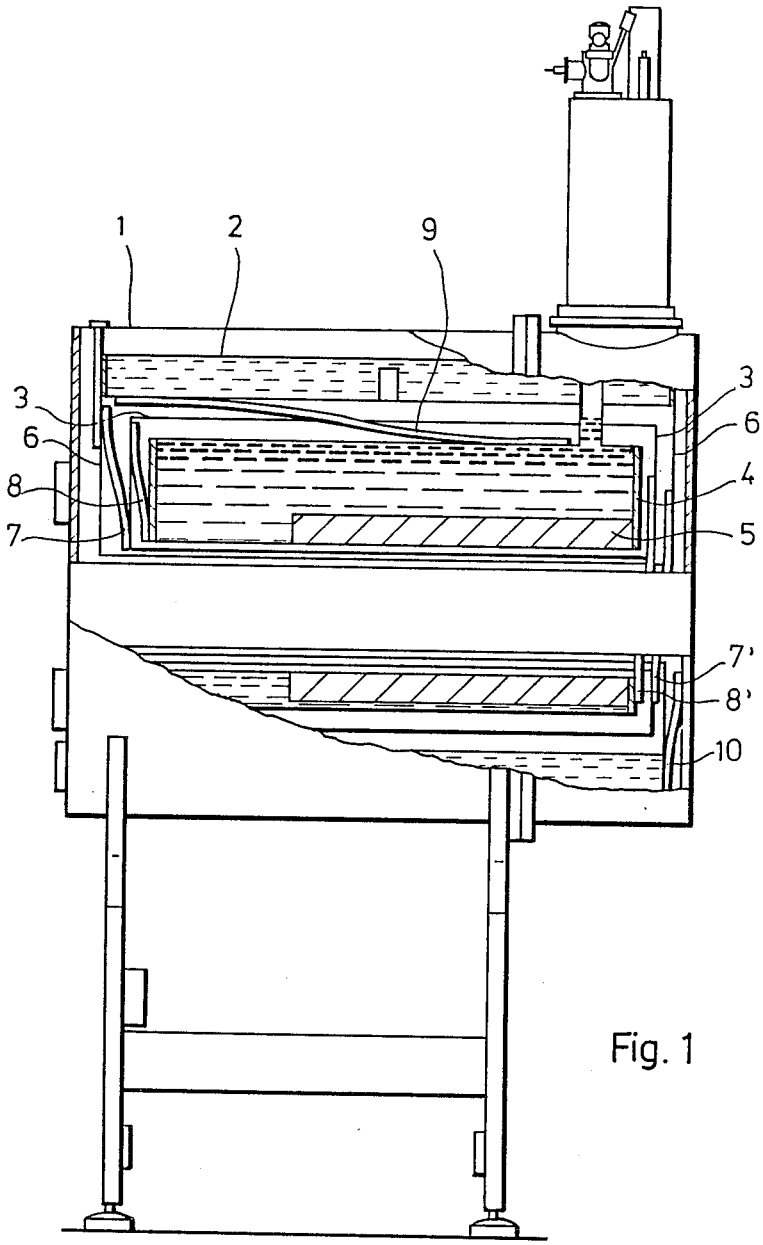

The present invention relates to a cryostat, in particular for superconductive magnets, comprising several components nested in each other, one of the said components forming an outer shell and at least another one constituting a vessel arranged inside the said shell and intended for receiving a refrigerant, and comprising further tension members for interconnecting the said components, each of the said tension members serving to suspend an inner component on the next outer neighboring component, all said tension members consisting of a fiber glass reinforced plastic material and being provided on their ends with lugs which are passed by bolts for fixing the tension members on the respective component.

In the case of cryostats for superconductive magnets having generally the before-described design the design of the tension members has been found to be particularly problematic. The tension members must exhibit high tensile strength, they are to carry safely the relatively big masses, and must at the same time show little thermal conductivity in order to keep the heat transfer to the interior of the cryostat as low as possible. In addition, they should be easy to produce and to install and should require the least possible space inside the cryostat as the space required by them may constitute a major factor with respect to the overall size of such a cryostat.

Fiber glass reinforced plastic materials provide high tensile strength and, at the same time, low thermal conductivity so that they are well suited for the production of tension members for cryostats. R.C. Nieman et al have investigated the properties of epoxy fiber glass tension members for cryostats of superconductive magnets and have described the results of their examinations in the paper presented to ICMC 1977, published in Adv. in Cryogenic Eng., Vol. 24, pages 283–289, Plenum Press, New York. These results show that tension members of rectangular cross-section comprising a bore at their ends for receiving a bolt are not suited for use in cryostats due to the stresses encountered in the area of the bore. Instead, they suggest the use of loops where glass fibers are wound around the bolts in a strand to retain the bolts. Although such loops provide the required high tensile strength, they are costly to produce. In addition, they cannot be produced with the desired close tolerances so that difficulties are encountered during assembly of the components of the cryostat when such loops are used as tension members. Finally, they also require considerable space, due to the necessary big cross-sections of their strands A paper by M.B. Kasen entitled "Materials at low temperatures", Am. Soc. Metals, Ed. Reed & Clark 1983, pages 41 to 60, recommends to use metallic end pieces in connection with the before-mentioned loops and to glue these end pieces to the fiber glass-reinforced plastic parts. It is easily understood that the production of such metal parts and their connection to the plastic strand by gluing is particularly costly and that glued connections between metals and plastic materials ar also inherently problematic.

Now, it is the object of the present invention to provide tension members for cryostats which can be produced in a simple manner and with close tolerances, while requiring only little space.

This object is achieved according to the invention by the fact that the tension members are designed as strip-like elements made from a plastic sheet material which is reinforced by a glass fiber weave, and comprise an elongated central portion with parallel edges, followed on both ends by enlarged areas comprising the lugs which are passed by the bolts.

The invention, therefore, makes use of a material which is available on the market as a cheap mass product and is used in large quantities, for example, in the production of motherboards for printed circuits. The tension members can be cut out from such sheets very easily, in the best suited shape and with very close tolerances. The enlarged portions provided at the ends of the tension members can be sized without any difficulty in such a manner that all forces encountered in the area of the lugs are perfectly absorbed and that this area of the tension member exhibits a strength in excess of that of the elongated central portion. It is a particular advantage in this connection that the glass fiber weave provides bidirectional reinforcement which prevents any splitting of the enlarged end of the tension member, even though the tensile strength of such a material may not fully reach the tensile strength of compound materials comprising a unidirectional reinforcement. Another advantage the tension members according to the invention is seen in the fact that their space requirement is determined mainly by their thickness, i.e. by their extension in the direction of the fixing bolts because this dimension determines the necessary spacings between the components of the cryostat. In contrast, the space available in the direction perpendicular thereto, i.e. parallel to the walls of the components, is almost unlimited so that the tension rods can easily be given the width required for achieving the necessary strength.

It has been found that a particularly advantageous shape of the tension members is obtained when the enlarged portions have the shape of a rectangular plate, with a bore forming the lug provided in the central area thereof, and when the transition between the width of the central portion and the width of the plate is formed by a transition portion of arc-shaped contour forming the tangential continuation of the lateral edges of the central portion. This arc-shaped contour may simply be a circular arc, or have a parabolic shape.

As mentioned before, the amount of heat transferred by the tension members must be kept as small as possible. The heat transfer is determined not only by the thermal conductivity of the tension members themselves, but also by the heat transfer from the components, on which the tension member is fixed, to the tension members. In this connection, the tension members used in the cryostat according to the invention provide the advantage that the small thickness of the tension members leads to relatively small contact surfaces between the tension members and the bolts carrying such members so that the heat transfer due to heat conduction is relatively small. On the other hand, the enlarged portions of the tension members exhibit a relatively big surface which faces the walls of the components, and this favors the heat transfer caused by radiation. Accordingly, it is provided according to a preferred embodiment of the invention that the tension members are provided with a reflecting coating, at least in the area of their enlarged portions, so as to minimize the heat transfer by radiation. It will be easily seen that the plate-like design of the tension members favors the application of such a reflecting coating.

A material which is particularly well suited for the production of the tension members according to the invention is commercially available under the tradename "Vertronit EP G10".

A particular advantage of the tension members according to the invention is seen in the fact that their ends can be fastened by a single bolt. The close tolerances with which the tension members can be produced make it possible to do without any means for adjusting the position of the components when these are suspended by means of the tension members. According to a preferred embodiment of the cryostat according to the invention the tension members are, therefore, mounted by means of a screw comprising a head and a cylindrical portion which forms the bolt passing the lug and whose end constitutes at the same time a stop limiting the penetration depth of the screw so that there is no risk that the tension member may get damaged due to improper mounting. Instead, it would also be possible to fasten the tension member by means of a plate with a sleeve-like extension which is passed through the lug in the tension member in the manner of a bolt and which is then fixed to the corresponding component by means of a screw passed through the said extension. This plate then performs the function of the head of the screw, in that it overlaps the edge of the lug and retains the tension member on its extension which in this case performs the function of the bolt.

The use of the screw described before, or of a plate provided with an extension, offers the particular advantage that the cylindrical portion of the screw or the extension of the plate can be sized conveniently to ensure that the tension member is held on the cylindrical portion of the screw or the extension of the plate with a certain play. The tension member can then follow all dimensional changes, without any stresses which would arise in particular after assembly of the cryostat, when the latter is cooled down to its operating temperature.

The structure of the cryostat according to the invention may be further simplified if the plates provided with the said extension are formed directly by portions of the components to be interconnected.

Another considerable advantage of the use of tension members according to the invention is seen in the fact that these tension members can be bent within certain limits in a direction perpendicular to the plane of the plate, without any detrimental effects on their tensile strength. In the case of a cryostat designed according to the invention the tension members may, therefore, directly interconnect portions of components arranged at a certain distance relative to each other, in parallel planes. It will be easily seen that this possibility leads on the one hand to a considerable further simplification of the structure of the cryostat and enables, on the other hand, the overall size of the cryostat to be further reduced, due to the suppression of any protruding fastening elements. In the case of cryostats whose components consist of concentrically arranged tanks and shields with cylindrical jacket surfaces and plane end faces, with their axes extending in the horizontal direction, the tension members may, for example, be arranged without any problems between the plane end faces of the vessels and/or the shields. On the other hand it is, however, also possible to provide additional tension members of the same design between the jacket surfaces of the components in order to absorb any horizontal shearing forces.

Figure 2:
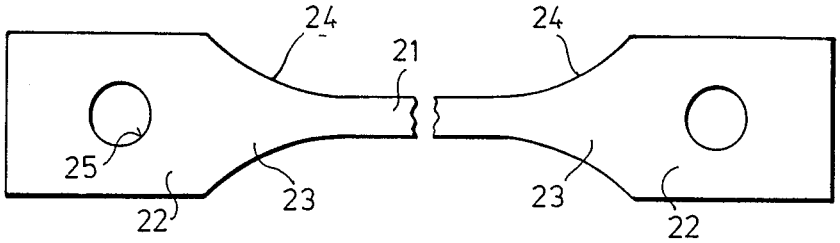
Figure 3:
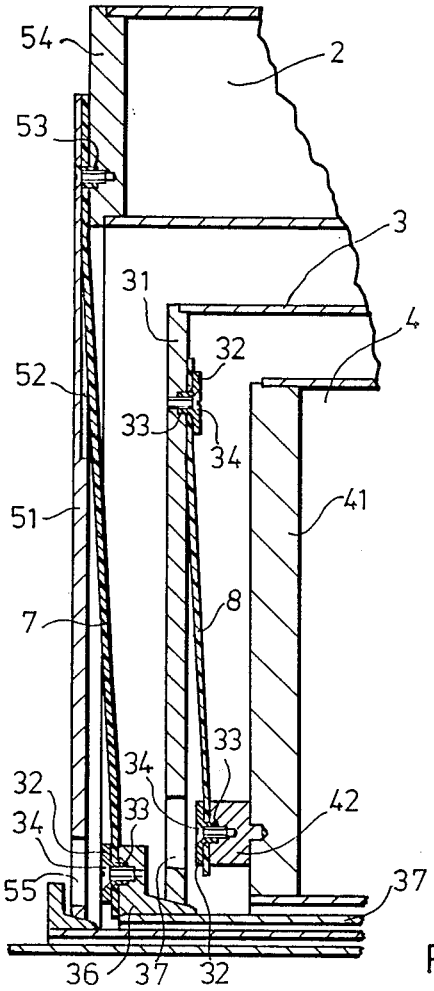
Figure 4:
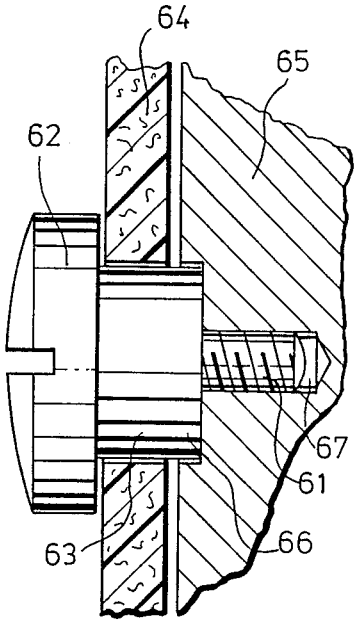

The invention will now be described in greater detail by way of the embodiments shown in the drawing. The features which can be derived from the specification and the drawing may be used in other embodiments of the invention either alone or in any combination thereof. In the drawing FIG. 1 shows a diagrammatic representation, partially as a side view and partially as a cross-section, of a cryostat designed according to the invention;

FIG. 2 shows a plan view of a tension member used in the cryostat according to FIG. 1;

FIG. 3 a shows a section of the cryostat of FIG. 1, in enlarged scale; and FIG. 4 shows a cross-sectional view of another embodiment of the mounting point of a tension member, in further enlarged scale.

The cryostat represented in FIG. 1 comprises an outer jacket 11 containing, in the order from the outside to the inside, a nitrogen tank 2, a shield 3 and a helium tank 4 with a superconductive magnet 5 enclosed therein. The shield 3 is fastened on the end face 6 of the nitrogen tank 2 by means of tension members 7. Similarly, the helium tank 4 is fastened to the shield 3 by means of tension members 8. The helium tank 4 is further connected to the nitrogen tank 2 by at least one axially extending tie rod 9. Finally, the nitrogen tank 2 is connected to the end faces of the jacket 1 by means of tension members 10.

All of the tension members used in the cryostat according to FIG. 1 exhibit the design represented in FIG. 2. i.e. they are cut out from plastic sheets which are reinforced by a glass fiber weave, and comprise an elongated central portion 21 with enlarged portions 22 provided on both ends thereof. Each of the enlarged portions 22 is connected with the central portion 21 via a transition portion 23 exhibiting an arc-shaped contour forming the extension of the respective edge of the central portion 21 and extending right to the edge of the enlarged portion 22. The arc-shaped contour 24 may simply be a circular arc, but may also have a parabolic shape. The enlarged sections 22 at the ends of the tension member take the form of a rectangular plate with a bore 25 provided in its central area for receiving a mounting bolt.

The sheet material is of the same type as used, for example, for the production of motherboards for printed circuits. The dimensions of the tension member are determined by the size of the cryostat, i.e. by the forces to be absorbed by the tension member. Generally, the width of the plate-shaped portion is approximately 4 times, its length approximately 5 times the width of the central portion 21. The diameter of the bore 25 should be about 1.5 times this width, the transition portion 23 should have an additional length equalling approximately 4 times the width of the central portion 21. In one example of a cryostat constructed according to the invention, the tension members used were cut out from plastic sheets of 3.5 mm thickness which are reinforced by a glass fiber weave and commercially available under the trade name "Vertronit EP G10". The central portion of such a tension member had a length of 460 mm and a width of 15 mm. The enlarged portions 22 on both ends had a width of 65 mm and a length of 82 mm. The bores 25 had a diameter of 24 mm and were provided at a distance of 48 mm from the ends of the tension member. The contour of the transition portions 23 was that of a circular arc with a radius of 80 mm. This resulted in a total length of the tension member of 733 mm and a center distance between the bores 25 of 640 mm. The ends of the tension member were provided with a reflecting coating. Given a tensile strength of the material of about 300 N/mm$^2$, such a tension member offers a tensile strength of approximately 15,000 N so that a high safety factor can be taken into consideration for its installation. Tension tests have shown that such a tension member will break in the area of its central portion while no destruction will be encountered in the are of its bores.

As can be seen best in FIG. 3, the upper end of the tension member 8, which forms the connection between the helium tank 4 and the shield 3, is fastened on the inside of the end wall 31 of the radiation shield. The fastening means consists of a plate 32 comprising a sleeve-like extension 33 engaging a corresponding blind bore in the end wall 31 and passing through the bore of the tension member 8 in the manner of a bolt. The plate 32 is fastened by means of a countersunk screw 34 which is passed through the sleeve-like extension and screwed into the end wall 31. The length of the sleeve-like extension, which is centered in the blind bore of the end wall 31, is such that the distance between the plate 32 and the surface of the end wall 31 is slightly greater than the thickness of the tension member 8 so that the tension member 8 is not clamped but permitted to pivot about the bolt formed by the sleeve-like extension 33. The lower end of the tension member 8 is fastened on the end wall 41 of the helium tank 4 in a corresponding manner, by means of a similar plate 32 and a countersunk screw 34. For bridging the distance between the end wall 41 of the helium tank 4 and the end wall 31 of the radiation shield 3, a pillow block 42, which is provided on its outside with the bores for receiving the sleeve-like extension 33 of the plate 32 and the countersunk screw 34, is provided on the outside of the end wall 41 of the helium tank 4. If the distance between the end walls 31, 41 is reduced correspondingly, one may also do without the pillow block 42 and mount the lower end of the tension member 4 directly on the end wall 41 of the helium tank 4.

The tension member 7 interconnecting the radiation shield 3 and the nitrogen tank 2 is mounted in the same manner, except that at the upper end of the tension member 7, the connection is not realized by means of a separate plate 32, but rather by means of a portion of an end wall 51 connected with the nitrogen tank 7, which end wall 51 is provided with a recess 52 in the area of the tension member 7 for receiving the latter. At the point where the bore of the tension member 7 is located, the end wall 51 is again provided with a sleeve-like extension 53 bearing against the end wall 54 of the nitrogen tank 2 and forming the bolt on which the tension member 7 is seated. And again, a countersunk screw 55 serves for fixing the end wall 51 and the tension member 7 in the area of the bolt formed by the sleeve-like extension 53. The lower end of the tension member 7 is again screwed to a bearing member 36 by means of a plate 32 provided with a sleeve-like extension 33 and a countersunk screw 34, and the bearing member 36 is mounted on an inner part of the jacket 37 of the shield 3.

The described simple manner of mounting the tension members is rendered possible not least by the fact that the tension members can be produced with close tolerances by cutting them out from a sheet material, so that there is no necessity for providing adjusting means. In addition, the pivoting arrangement of the tension members ensures that the interconnected components will necessarily always occupy their balanced position so that no uncontrollable stresses will arise. This is important also in view of the fact that after production of the cryostat dimensional changes will occur when the cryostat is cooled down to its operating temperature, and that such dimensional changes can be absorbed without any difficulty by the tension members. An important factor in this respect is to be seen also in the fact that the tension members permit not only a pivotal movement about their bolts, but also, within certain limits, a certain amount of distortion about an axis extending parallel to the plane of the sheet, without any detrimental effects on their tensile strength. In the case of the before-described material, this distortion may be in the range of up to approx. 5°. Accordingly, the connection points of the tension members need not be arranged in a common plane, but may be provided in offset parallel planes as shown in FIG. 3; and tension members of this type may also be mounted between tightly neighboring walls, without the use of any special bearing members. It will be further seen that the tension members, which are mounted between parallel end walls, require only little space in the axial direction of the interconnected components so that their arrangement has practically no influence on the length of the cryostat, while sufficient space is available in the direction parallel to the end walls so that the width of the tension members can be adapted conveniently to meet the strength requirements of the particular case. Finally, the described manner of mounting the tension members provides the additional advantage that during assembly of the cryostat the tension members can be fastened on the inside of the outer component before the inner component is introduced into the outer one and that the tension bar can then be fastened on the outside of the inner component through a recess 37 or 55 in the outer component, it being easily possible to screw in a screw through a recess which can then be closed without any problems if this should be necessary.

Instead of using discs with extensions which are held in place by a countersunk screw, for connecting the tension members according to the invention, it is also possible—as shown in FIG. 4—to use special screws 61, comprising a head 62 followed by a cylindrical portion 63 forming a bolt which is passed through the lug in the tension member 64. The end face of the cylindrical portion 63 then forms again a stop for limiting the depth of penetration of the screw 61 into the component 65 on which the tension member 64 is mounted, so that the head 62 of the screw is located at a defined distance from the surface of the component 65, which distance ensures that the tension member 64 is seated with a certain play on the bolt formed by the cylindrical extension 63. In the embodiment shown in FIG. 4, the cylindrical portion 63 of the screw 61 again engages an enlarged portion 66 of the bore 67 serving for receiving the screw 61, and performs in this manner a centering function so that the cylindrical portion 62 occupies an exactly defined position relative to the component 65.

It is understood that the invention is not restricted to the embodiments shown, but that deviations are possible without leaving the scope of the invention. For example, the size and the arrangement of the tension members are necessarily determined by the structure of the cryostat whose components are to be interconnected by such tension members. The tension members according to the invention are just as well suited for cryostats whose components ar arranged with their axes extending in the vertical direction, as they are for cryostats with horizontal axis. Further, these tension members can be used also in cases where a super-insulation is provided between the components of the cryostat. Finally, it goes without saying that other suspension and/or supporting elements serving to connect the components may be used in one and the same cryostat, in addition to the tension members designed according to the invention.

We claim:

1. Cryostat, in particular for superconductive magnets, comprising several components nested in each other, one of the said components forming an outer shell and at least another one constituting a vessel arranged inside the said shell and intended for receiving a refrigerant, and comprising further tension members for interconnecting the said components, each of the said tension members serving to suspend an inner component on the next outer neighboring component, all said tension members consisting of a fiber glass reinforced plastic material and being provided on their ends with lugs which are passed by bolts for fixing the tension members on a respective component, said tension members (7,8) being formed as strip-like unitary elements from a homogeneous plastic sheet material which is reinforced by glass fiber weave means for providing bidirectional reinforcement of said homogeneous plastic sheet material, said strip-like elements comprising an elongated central portion (21) with parallel edges, followed on both ends by enlarged areas (22) having the lugs (25) which are passed by the bolts.

2. A Cryostat according to claim 1, wherein the said enlarged portions (22) have the shape of a rectangular plate, with a bore (25) forming the lug provided in the central area thereof, and a transition between a width of the said central portion and a width of the enlarged areas (22) is formed by a transition portion (23) of arc-shaped contour (24) forming the tangential continuation of the parallel edges of the said central portion (21).

3. A Cryostat according to claim 2, wherein the arc-shaped contour has a parabolic form.

4. A Cryostat according to claim 2, wherein the tension members (7, 8) are provided with a reflecting coating at least in the area of their enlarged portions (22).

5. A Cryostat according to claim 1, wherein the tension members (7, 8) comprise a material commercially available under the trade name "Vetronit EP G10".

6. A Cryostat according to claim 1, wherein the bolt passing through the said lug is formed by the cylindrical portion (63) of a screw (61) which follows the head (62) of the said screw (61) and whose end forms at the same time a stop limiting the depth of penetration of the said screw.

7. A Cryostat according to claim 6, wherein the tension said member (64; 7, 8) is retained on the said cylindrical portion (63) of the said screw (61) with a certain play.

8. A Cryostat according to claim 1, wherein the bolt passing through the said lug of the said tension member is formed by a sleeve-like extension (33) located on one side of a plate (32) overlapping the edge of the said lug, and is fixed to the respective component by means of a screw (34) passed through the said extension (33).

9. A Cryostat according to claim 8, wherein the tension member (64; 7, 8) is retained on the said extension (33) of the said plate (32) with a certain play.

10. A Cryostat according to claim 8, wherein the plate with the said extension (53) is formed by a portion of the components (51) to be interconnected.

11. A Cryostat according to claim 1, wherein the tension member (7, 8) is disposed for directly connecting portions of the said components (2,3; 3,4) provided in spaced arrangements in parallel planes.

12. A Cryostat according to claim 1, wherein the components comprise concentrically arranged tanks (2, 4) and shields (3) with cylindrical jacket surfaces and plane end faces (31, 41, 51) arranged with their axes extending in the horizontal direction, and that the tension members (7, 8) are arranged between the plane end faces (31, 41, 51) of the components.

13. A Cryostat according to claim 12, further comprising additional tie rods (9) arranged between the jacket surfaces of the components (2, 4).

14. Cryostat tension member apparatus comprising:

a strip-like unitary element (7, 8) formed from a homogeneous plastic sheet material having bidirectional reinforcement fibers therein, said strip-like unitary element (7, 8) having an elongated central portion (21) with parallel edges, enlarged areas (22) on opposite ends of said strip-like unitary element (7, 8) and means defining bore holes (25) through said enlarged area (22) for mounting of said strip-like member (7, 8); and a plurality of cryostat components (2, 3; 3, 4) disposed in a spaced apart parallel arrangement with a plurality of strip-like unitary members (7, 8) disposed therebetween.

15. The tension member apparatus according to claim 14 wherein said cryostat components comprise concentrically arranged tanks (2, 4) and shields (3) having cylindrical jack surfaces and plane end faces (31, 41, 51) arranged with their axes extending in the horizontal direction and a plurality of strip-like unitary member (7, 8) are disposed between the plane end faces (31, 41, 51) of the cryostat components.

* * * * *